United States Patent [19]

Ressi di Cervia

[11] Patent Number: 4,728,226

[45] Date of Patent: Mar. 1, 1988

[54] METHOD AND APPARATUS FOR FORMING REINFORCED CONCRETE WALLS WITH CONTINUOUS STEEL REINFORCEMENT

[75] Inventor: Arturo L. Ressi di Cervia, New York, N.Y.

[73] Assignee: Finic, B.V., Rotterdam, Netherlands

[21] Appl. No.: 598,632

[22] Filed: Apr. 10, 1984

[51] Int. Cl.[4] ..... E02D 5/20; E04B 1/16

[52] U.S. Cl. ..... 405/267; 52/742; 52/744

[58] Field of Search ..... 405/266, 267, 275, 287; 52/169.9, 742, 743, 744, 169.14; 264/33–35

[56] References Cited

U.S. PATENT DOCUMENTS

| | | | |
|---|---|---|---|
| 3,197,964 | 8/1965 | Fehlmann et al. | 405/267 |
| 3,310,952 | 3/1967 | Veder | 405/267 |
| 3,422,627 | 1/1969 | Courte | 405/267 |
| 3,431,736 | 3/1969 | Ueda | 52/743 X |
| 3,452,546 | 7/1969 | Noret | 405/267 |
| 3,513,572 | 5/1970 | Noret | 405/267 X |
| 3,938,292 | 2/1976 | Kawasaki et al. | 52/742 |
| 3,990,200 | 11/1976 | Kawasaki et al. | 52/742 X |
| 4,453,862 | 6/1984 | Stenne | 405/267 |

FOREIGN PATENT DOCUMENTS

| | | | |
|---|---|---|---|
| 111719 | 9/1981 | Japan | 405/267 |
| 139306 | 10/1981 | Japan | 405/267 |
| 21621 | 2/1982 | Japan | 405/267 |
| 130623 | 8/1982 | Japan | 405/267 |

*Primary Examiner*—Nancy J. Stodola

*Attorney, Agent, or Firm*—Jim Zegeer

[57] ABSTRACT

Improvement on the method and apparatus for forming reinforced concrete walls with continuous steel reinforcements is disclosed in Veder U.S. Pat. No. 3,310,952. The process includes the forming of a plurality of concrete panels, each panel having a reinforcing cage extending to proximate the joint between the concrete panels and one or more expansible joint reinforcing cages bridging the gap between the reinforcing cages in the adjoining panels. The expansible joint reinforcing cages are carried in carriers in an end stop pipe. Each expansible joint reinforcing cage is comprised of a vertical support bar having secured thereto a plurality of horizontally extending concrete anchor members rigidly secured to one surface of the vertical support bar. A plurality of reinforcing bar members are pivotally coupled to the vertical support bar member and an operating rod member or channel member is coupled to the opposite ends of the these reinforcing bar members and shifts them from a substantially vertical position to a substantially horizontal position after the stop pipe has been removed and the next succeeding panel excavation performed. The vertical orientation of these reinforcing bar members as well as their operating member assures that they will be removed from the area of excavation of the next succeeding and adjacent panel section and, at the same time, by virtue of the concrete anchor members they are rigidly and securely anchored in the preceding concrete panel element. In a preferred embodiment, the vertical bar member is a channel member and the operating rod member is a similar channel member.

17 Claims, 13 Drawing Figures

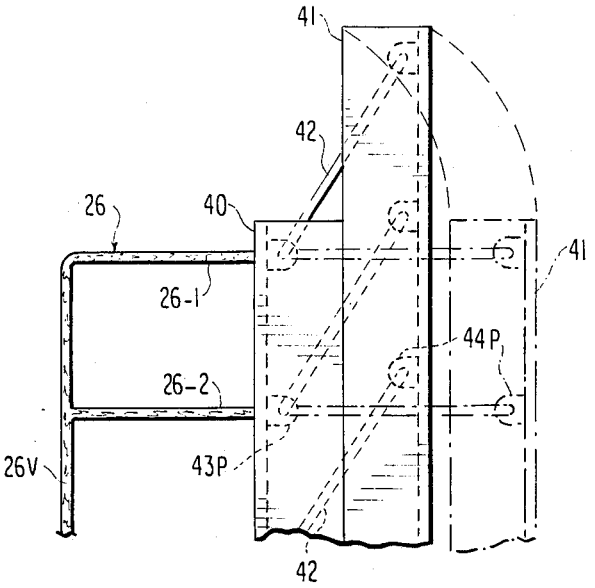
FIG. 1
FIG. 4
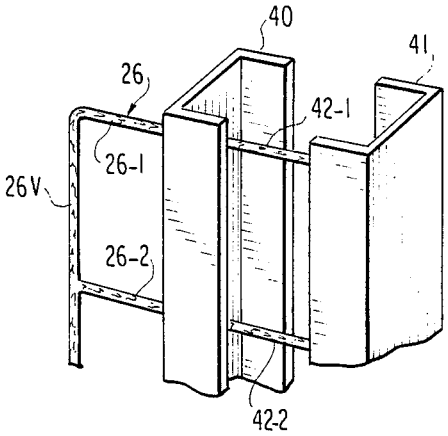
FIG. 2
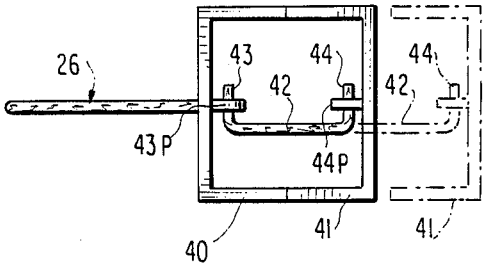
FIG. 3
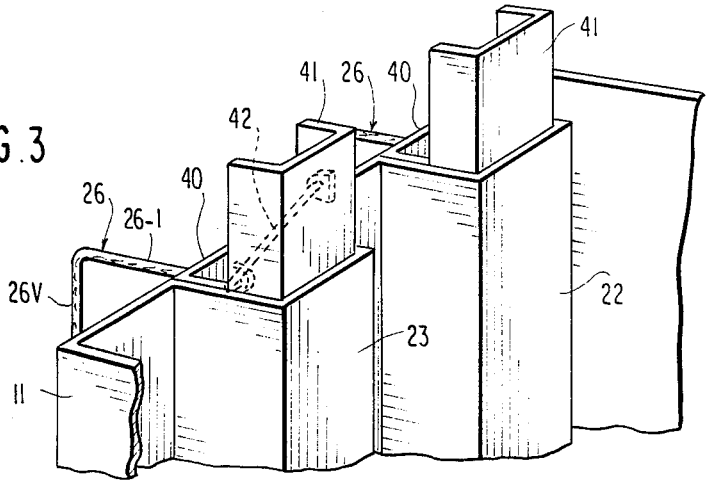

METHOD AND APPARATUS FOR FORMING REINFORCED CONCRETE WALLS WITH CONTINUOUS STEEL REINFORCEMENT

BACKGROUND AND BRIEF DESCRIPTION OF THE INVENTION

The construction of reinforced concrete walls using the slurry trench technique as basically disclosed in Veder U.S. Pat. Nos. 2,791,886 and 3,310,952 are well known in the art and basically comprise the formation of the slots or trench sections in the earth in panel form in the presence of a slurry, typically a bentonite slurry which is displaced by concrete to form concrete walls. In the case of steel reinforced walls, a slot is excavated in the earth in the presence of the bentonite slurry, a stop end pipe is inserted in one end of the slot and a steel reinforcing cage is then lowered into the slot. Concrete is then inserted into the slot or trench to displace the bentonite slurry, such concreting typically being done by the tremie pipe technique. After the concrete has hardened, the stop end pipe is removed to form the beginning space for the next succeeding panel section.

There have been many efforts in the past to create a continuous reinforcement in such slurry walls but a simple solution to the problem has eluded the art for many years. In Fehlmann et al U.S. Pat. No. 3,197,946, a steel sheathing such wire netting, perforated sheet metal or the like, permits the reinforcing rods to pass through the meshes at approximate the ends of the slot so as to form a cavity which is filled with the bentonite for the purpose of providing a starting place for the next succeeding excavating and the formation of the joint. In Schoewert U.S. Pat. No. 3,464,665, a steel plate is connected to the template plate in a detachable manner and is left in to bridge the gap. In Kawaski et al U.S. Pat. Nos. 3,938,292 and 3,990,200, protruding reinforcements and sealing means for positioning the protruding reinforcements are provided and inflattable elements are utilized to shield the protruding reinforcements, and dam or block the concrete and form the open space for the next succeeding excavation and coupling between two units. In Irwin-Childs U.S. Pat. No. 3,798,914, cruciform shaped coupling elements are utilized to form the coupling between adjacent panel elements. In Novet U.S. Pat. Nos. 3,513,572 an intermediate reinforcing cage is utilized. In some cases, such as in Tamaro U.S. Pat. No. 4,005,582, flanges on connected on H-beam pairs provide the coupling between the steel reinforcements. In some cases, the ends of the elements and their associated reinforcing cages are shaped to provide overlap between successive panel elements. Finally, in Piccagli U.S. Pat. No. 3,796,054, flexible membranes are carried in the stop end pipes which remain in place when the stop end has been removed so as to provide a barrier to the flow of fluids.

The present invention provides a simple solution to a problem that has eluded the art for many years. According to the invention the excavation initially begins as described in the aforementioned Veder U.S. Pat. No. 3,310,952. In this case, the stop end pipe is preferably rectangular, as has been used heretofore, and has a pair of channels formed adjacent the sides thereof. Into each channel is placed an expansible joint reinforcement cage. In one preferred embodiment, this expansible joint reinforcement cage comprises a pair of channels which are interconnected by pivoted lengths of rebars of appropriate lengths. One of the channels facing the side in which concrete is to be poured is provided with concrete anchors which extend into the excavated space. The two channels are in a "closed" position and may have styrofoam or other means to prevent concrete from entering in between them during the pour and may be fastened together at the top. the concrete anchor reinforcing bars which extend from the channel into the space to be poured assure that this assembly will be firmly embedded into the newely poured concrete panel. When the rectangular stop end piece has been pulled out at the end of the pour, any frictional effects during the pulling out of the panel will tend to keep the channel assembly "closed". The adjacent panel section or slot is then excavated, a reinforcement cage is then placed inside this newely excavated panel section. At this point, the expandable reinforcing cage is expanded by disconnecting the channels at the top, the one sticking up is tapped vertically which will result in its swinging out until the linkage reinforcing bars are in a horizontal position. These constitute the continuity of the reinforcement and the second panel section is then poured or filled with concrete.

The invention has the advantage that it is simple, relatively inexpensive, very workable and easy to install, since normally continuity of the reinforcement is located in the upper portion of the panels and does not normally extend to the full depth. Moreover, since the joint reinforcement cage is expandable, it is normally maintained in an out-of-the-way and protected position during the excavation of the adjoining panel section and thereby avoids interference with the extensive horizontal protrusions in the joint reinforcing sections as is performed in the prior art such as in the above-mentioned Kawasaki et al patents and Fehlmann et al patents.

BRIEF DESCRIPTION OF THE DRAWINGS

The above and other objects, advantages and features of the invention will become more apparent when considered with the following specification and accompanying drawings wherein:

FIG. 1 is a side elevational view of the expandable joint reinforcing cage incorporating the invention, FIG. 2 is a top view thereof, FIG. 3 is a partial side isometric view showing the unit as it is being installed into the stop end tube, FIG. 4 is an isometric view showing the expanded unit.

Referring to FIGS. 5, 6, 7 and 8, a reinforced concrete wall is illustrated in the process of being formed, and the total length of the reinforced concrete wall itself may comprise many (N) individual panel elements. Initially the trench or slot section 10 is excavated by a clam shell (not shown) to a desired depth in the presence of a slurry which typically is bentonite. A rectangular end stop pipe 11 has been inserted in one end of trench section 10. A conventional reinforcing cage 12 which consists of horizontal rods 13 and 14 adjacent each side of the wall for maximum strength purposes and vertical spacer bars 16 and 17 associated with each horizontal run, and spacer bars 19 extending between the two side reinforcing assemblies.

Rectangular end stop pipe 11 has a pair of channels 22, 23 which serve as carriers for expandable joint reinforcing cages 24 and 25, respectively. Expandable joint reinforcing cages 24 and 25 have associated therewith integral concrete anchors 26 and 27, respectively, which project into the previous excavation and between the ends 28 and 29 of the reinforcing assemblies 13 and 14. In the condition shown in FIG. 5, the trench panel section 10-1 is full of bentonite used in maintaining and sustaining the excavation walls of the slot or trench panel sections and permits the reinforcing cage and the end pipe to be easily inserted and accurately positioned. As shown in FIG. 6, concrete has been inserted into the trench, 10-1 preferrably by the tremie method in which a pipe is inserted into the excavation and concrete is forced through the pipe so as to fill the trench from the bottom up with the end of the pipe being maintained in the rising bed of concrete, various vibration means and the like being utilized, if desired, as is conventional.

Figure 5:
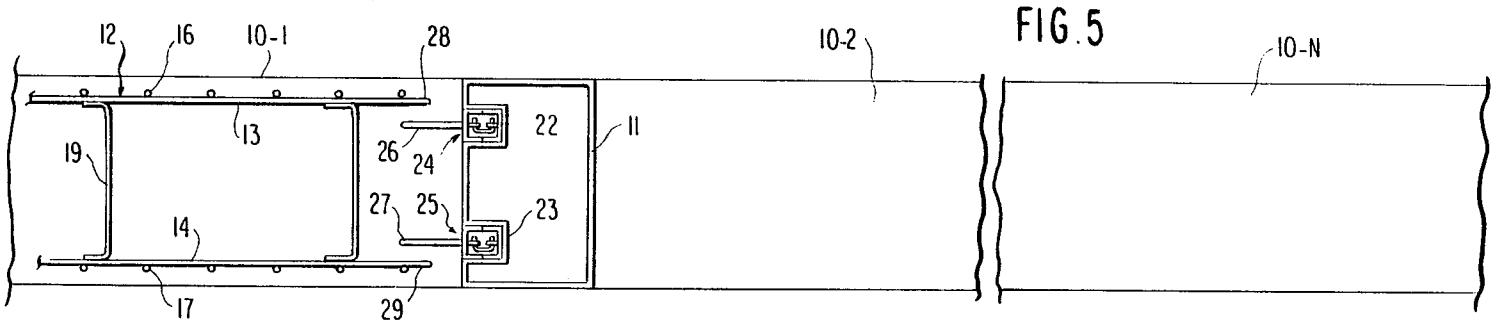
FIG. 5 is a top plan view showing the inserted position of a pair of the assembly shown in FIG. 1-4 in the end stop pipe of a panel section being formed prior to concreting thereof.
Figure 6:
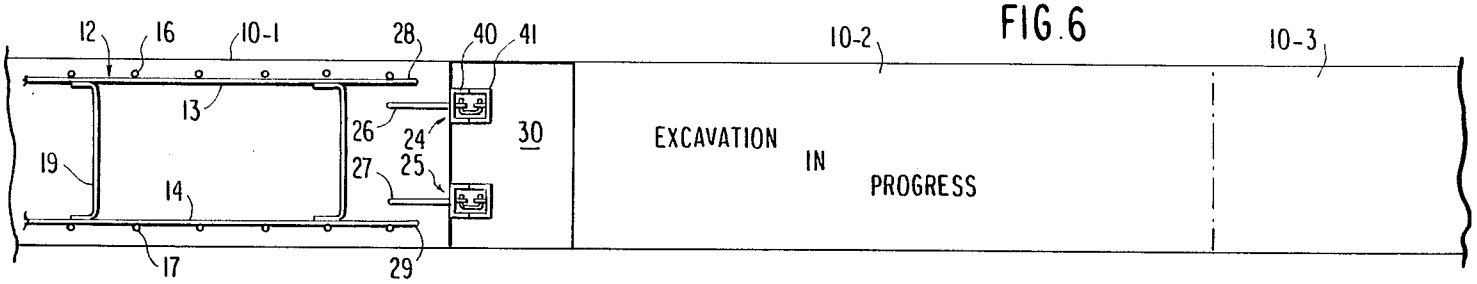
FIG. 6 is a top plan view after the concreting of the first panel section with the excavation in the second panel section being in progress.
Figure 7:
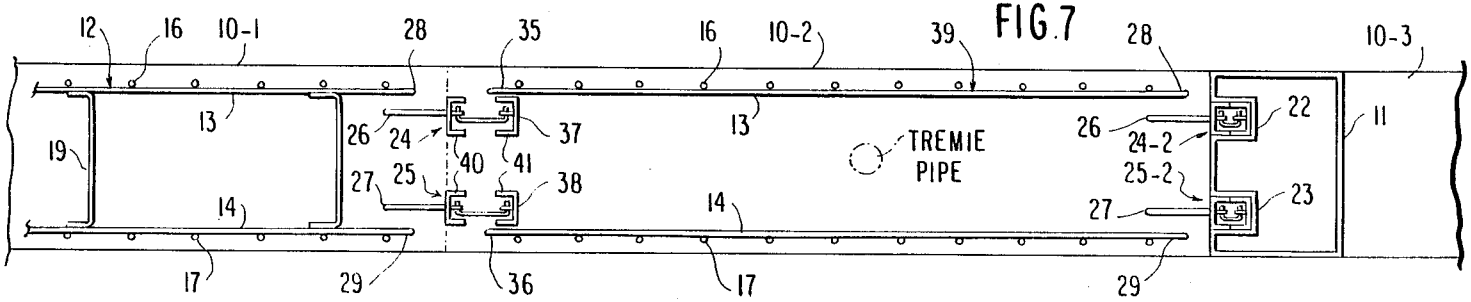
FIG. 7 is a top plan view showing the expanded sections of the joint reinforcing cage and the juxtaposition of the reinforcing cage in the second panels section ready to be concreted.
Figure 8:
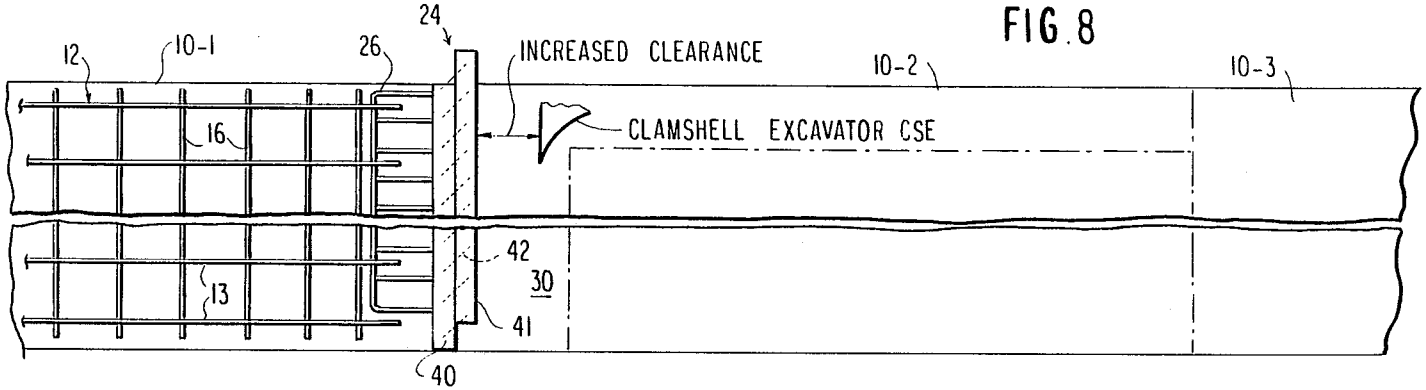
FIG. 8 is a side elevational view of FIG. 6 showing the immersed clearance for the excavating tool in the practice of the invention.

After the concrete has set, the rectangular end stop pipe 11 is pulled from the trench and since the concrete anchors 26 and 27 of the expandable joint reinforcing cages 24 and 25 are anchored into the poured concrete, the assemblies remain in place as the rectangular end stop pipe 11 is withdrawn and pulled from the trench. This leaves a space 30 which forms the end position of the next slot or panel trench excavation. Moreover, as will be explained more fully hereafter, the expandable joint reinforcing cages 24 and 25 are maintained in the unexpanded or collapsed condition so as to provide protection for these assemblies and, at the same time, provide more working room for the excavating equipment as shown in FIG. 8. At this point, it should be recalled that in the prior art, the extended ends of the horizontal runs of the reinforcing bars projected into such space and could in practice be bent by the excavating clam shells and the like or other excavating equipment as it was dropped into and pulled out of during the excavation of the next panel section, panel section 10-1 in FIGS. 5–8.

After the excavation of the slot or trench for panel section 10-1, a further reinforcing cage constructed similar to the reinforcing cage that was inserted into panel slot 10-2 is inserted into panel slot 10-1 and it has ends 35, 36 which project into the space 30 formerly occupied by the rectangular end stop 11. The expandable reinforcing cages 24 and 25 are expanded so that the reinforcing bars 37 and 38 forming part of the reinforcing cage 24, 25 overlaps the ends 35, 36 of reinforcing cage 39 in panel section 10-1. At this time, the rectangular stop pipe 11 has been inserted in the opposite end (in this case the right end) of panel slot or trench 10-1 and carries a further pair of expandable reinforcing cages 24-2, 25-2 carried in slots 22 and 23, respectively, of end stop pipe 11 so that the process can be repeated. The joint reinforcing cages obviously can be inserted after the end stop pipe 11 has been inserted but in instances where the joint reinforcing cage does not extend to the bottom of the panel section, preparation of the bottom portion of the cages 24, 25 to avoid concrete impeding the later expansion thereof can be effected above ground. However, this is not a serious consideration since the lowest horizontal bars can be eliminated, if desired. Concrete is then poured in the trench in the manner indicated above and the process is repeated.

Figure 9:
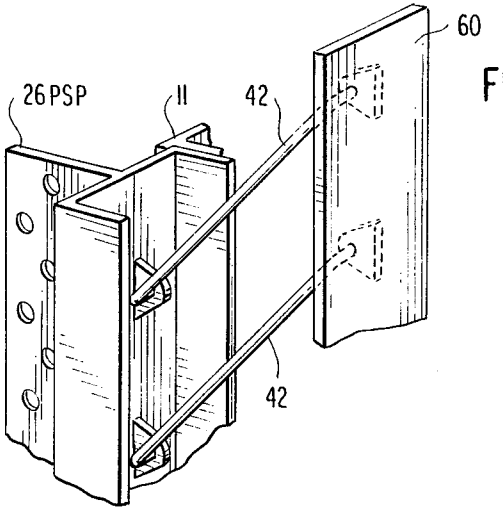
FIG. 9 is a side isometric view of a modification of the expandable joint reinforcing cage.

As shown in FIG. 1, the expandable joint reinforcing cage in this embodiment is constituted by a pair of opposing channel members 40, 41 linked together by a plurality of concrete reinforcing bars 42, each of which has its lateral ends 43, 44 pivotally coupled or connected to channel members 40 and 41, respectively by pivot members 43P and 44P, respectively. The channel member 40 constitutes a vertical support bar member and has a plurality of horizontally extending concrete anchor members 26-1, 26-2 . . . which are secured as by welding to one surface of the vertical support bar member constituted by channel 40. A vertical run 26V may be secured to the ends of bars 26-1, 26-2 so as to maintain them vertical and avoid bending the ends of the bars 26-1, 26-2 . . . 26-n. It will be appreciated that the anchor 26 may be means constituted by a perforated steel plate 26 PSP which has been welded to the base of channel member 40 as shown in FIG. 9. Each of the ends 43, 44 of the reinforcing bars 42 is bent and passes through an eyelet or opening in pivot means 43P and 44P welded to the insides of the U-shaped channel members 40, 41. The ends 43 and 44 could be in the form of eyelets (not shown). Channel member 41 constitutes an operating rod member for moving the plurality of reinforcing bar members 42 from a substantially vertical position to a substantially horizontal position. As indicated in FIGS. 1 and 2, the position during the installation of the expandable joint reinforcing cage assembly in rectangular end stop pipe member 11 and after removal of the end stop pipe 11 and during the excavation of the next adjacent panel section 10-1 (in FIG. 6) the expandable joint reinforcing cage is maintained in a collapsed or closed condition which is indicated in solid lines in FIGS. 1 and 2. After the end stop pipe 11 has been withdrawn from the excavation and the excavation of the adjoining slot or panel section 10-1 completed the next conventional reinforcing cage 39 is installed.

Figure 12:
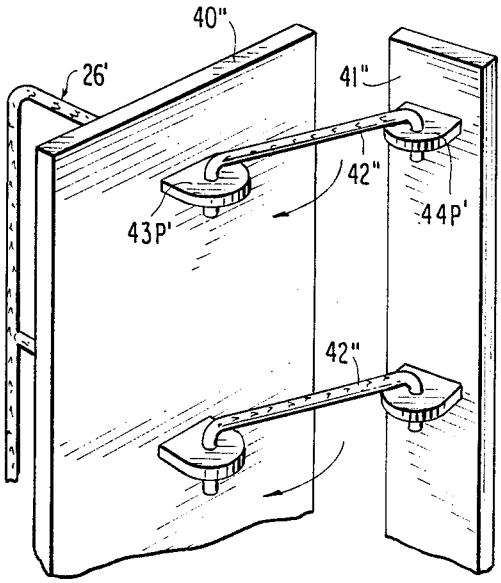
FIG. 12 illustrates a further modification and, FIG. 13 is a further embodiment when the channels in the rectangular stop end pipe are on the exterior thereof.

The expandable joint reinforcing cages are maintained in this collapsed position first to protect the assembly from damage by the excavating equipment and also to provide an additional space or room to facilitate the use and manipulation of the excavating equipment CSE, such as a clam shell, clam bucket, drilling rigs and the like without damage to the reinforcing bars and cage and making the excavation procedure somewhat easier and simplier. After the excavation has been completed, and the reinforcing cage 39 inserted into panel slot 10-1, the upper end of the channel member 41 is tapped in the direction of the arrow and moved downwardly which causes all of the reinforcing bars 42 to swing or move about an arc thereby extending the joint reinforcing cage to the position shown in dotted lines in FIGS. 1 and 2 and to the solid lines shown in FIG. 7. It is, of course, possible that the bars could swing on a horizontal arc as indicated in FIG. 12 when the pivots 43P' and 44" permit the operating bars 41" to swing horizontally about a vertical axis.

The slots 22 and 23 for retaining the expandable joint reinforcing cage in a closed position extends for the full length of the end stop pipe elements 11. It is anticipated in a number of cases that the joint expansion reinforcing cage need only extend for a certain portion of the depth of the wall, e.g. only where the additional strength is needed. In such cases, the expandable reinforcing cages need not extend for the full depth of the wall but only for that portion of it as needed. In such cases, the bottom end of the cages are sealed as by means of blocks of styrofoam and the like so as to prevent the intrusion of concrete which would prevent or impede the expansion and opening of the expandable cage to the position shown in FIGS. 1 and 2. A weak cement may be used at the lower extremities of the expandable cage in the channel members to plug or block the flow of the concrete in the cast section from entering into or flowing up into the U-shaped channels 40 and 41. It doesn't significantly affect the strength if the lower horizontal reinforcing bar 42 is broken off during the expanding operation, particularly since the length or height of the cage can easily be designed for such contingency.

Figure 10:
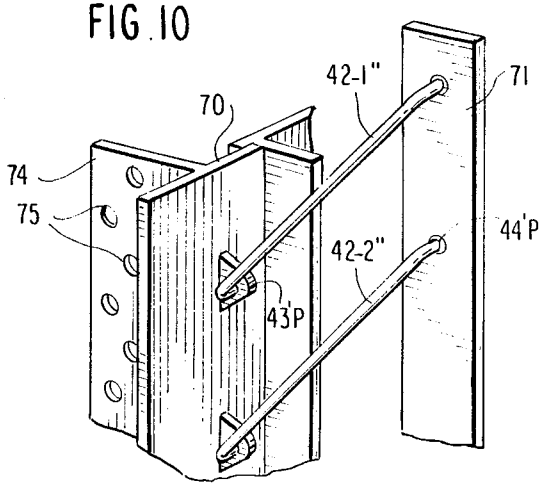
FIG. 10 is a side isometric view of a further modification of the joint reinforcement cage.
Figure 11:
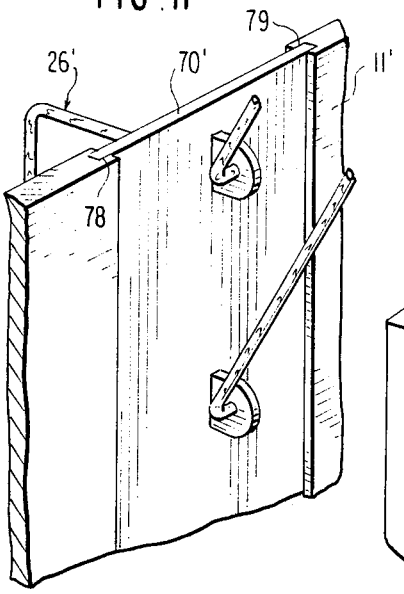
FIG. 11 is a modification of the end stop pipe.

As shown in FIG. 9, the channel member 41 has been replaced by a flat plate 60 which serves as the operating rod member for moving the plurality of reinforcing bars from a substantially vertical position to the substantially horizontal position. In FIG. 10, both U-shaped channel members have been replaced. The function of the channel members is performed by a vertical support bar member 70 and an operating rod member 71 moves the plurality of reinforcing bar members 42-1", 42-2" . . . 42-n". The anchor bar members have been replaced by a perforated slate 74 having a plurality of perforations 75 therein. In FIG. 11, the vertical support bar 70' is in grooves 78, 79 formed in end stop member 11'. In the embodiment shown in FIG. 11, a Teflon coating may be applied to the grooves and operating rod member 72 may be tapped downwardly while in the slot of rectangular end stop pipe 11' so as to cause the linkage to bear against the slots 76 and 78 thereby assuring the sealing against the entry of concrete which might impede the opening or expanding of the expandable joint reinforcing cages. In FIG. 12, the joint reinforcing members 42' are pivoted for horizontal swinging by operating bar 41".

Figure 13:
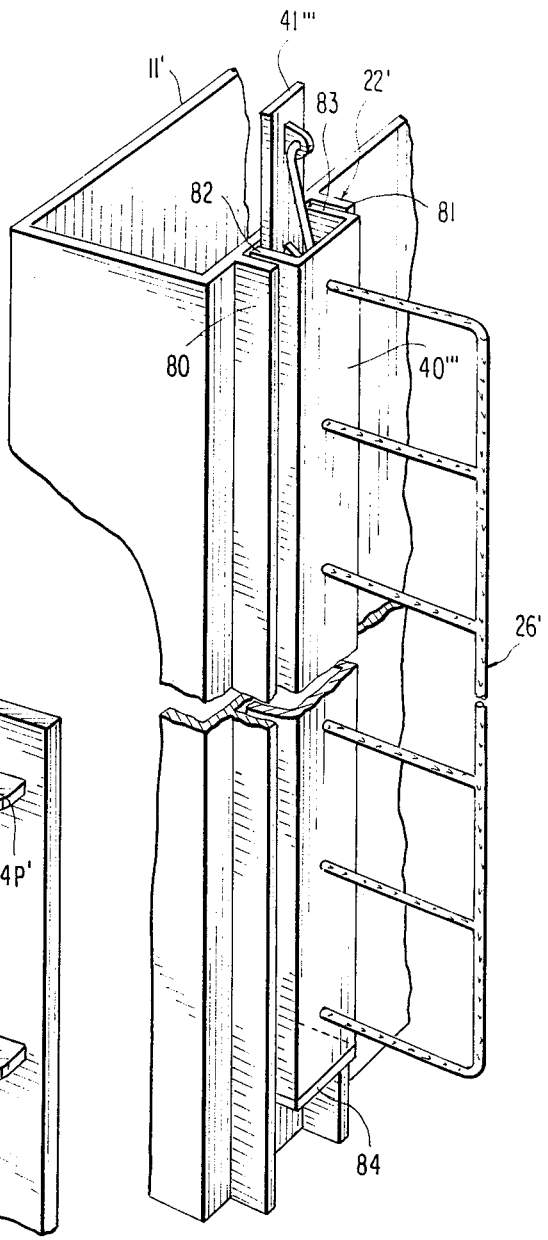

Referring now to FIG. 13, the carrier channels 22' and 23' (only one being shown) are carried on the exterior surface of end stop pipe 11'. Each channel includes a pair of plates or ribs 80, 81 which are spaced the distance between legs 82 and 83 of vertical support bar or channel 40". The operating bar 41'" is nested within the confines of the two channels and a bottom closure 84 is secured to the bottom of the channel 40" prevent concrete from rising in the channel and possibly interfering with the expansion of the joint reinforcing cage.

While I have shown and described a preferred embodiment of the invention, it will be appreciated that various other embodiments as will become obvious to those skilled in the art is intended to be encompassed by the claims appended hereto.

What is claimed is:

1. In a slurry trench method of constructing an underground concrete wall in a plurality of panel sections with continuous steel reinforcement, wherein a first panel section is excavated, an end stop pipe is placed in an end of said first panel section after excavation thereof, said end stop molding pipe has at least one concrete forming surface extending to the full length thereof, the improvement comprising, providing at least one groove in said concrete forming surface of said molding pipe with an expandable steel reinforcing cage in said groove, said expandable steel reinforcing cage having a concrete anchor means projecting therefrom beyond said concrete forming surface and into a body of concrete cast thereagainst, casting concrete in said first panel section to surround said concrete anchor means and against said concrete forming surface, removing said molding pipe from said first panel section, excavating an adjacent panel section, expanding said expandable steel reinforcing cage into said adjacent panel section, and filling said adjacent panel section with concrete.

2. The method defined in claim 1 wherein said expandable steel reinforcing cage is maintained in an unexpanded and protected position during excavation of said adjacent panel section.

3. In a slurry trench method of constructing an underground concrete wall in a plurality of panel sections with continuous steel reinforcement, wherein a first panel section is excavated, an end stop pipe is placed in an end of said first panel section after excavation thereof, said end stop molding pipe has at least one concrete forming surface extending to the full length thereof, the improvement comprising, providing at least one groove in said concrete forming surface of said molding pipe with an expandable steel reinforcing cage in said groove, said expandable steel reinforcing cage having a concrete anchor means projecting therefrom beyond said concrete forming surface and into a body of concrete cast thereagainst, casting concrete in said first panel section to surround said concrete anchor means and against said concrete forming surface, removing said molding pipe from said first panel section, excavating an adjacent panel section, expanding said expandable steel reinforcing cage into said adjacent panel section, filling said adjacent panel section with concrete, said expandable steel reinforcing cage including a plurality of pivoted reinforcing bars which are maintained in a substantially vertical position, and after excavation of said adjacent panel section, all said pivoted reinforcing bars are simultaneously moved in a vertical direction to a horizontal position into said adjacent panel section prior to filling of said adjacent panel section with concrete.

4. The invention defined in claim 3 wherein said expandable reinforcing cage includes an operating member which physically projects above said slurry trench and expands said expandable steel reinforcing cage by being moved in a vertically downward direction.

5. The invention defined in claim 4 wherein said operating member is a U-shaped channel member which protects said expandable reinforcing cage during excavation of an adjoining and overlapping slurry trench section.

6. The invention defined in claim 3 wherein each said reinforcing bar has (1) a first end pivotally connected to a member secured to said concrete anchor means, and (2) a second end pivotally connected to an operating member which projects upwardly above the slurry trench, and the step of expanding said expandable steel reinforcing cage is performed by applying a force to move said operating member in a vertically downward direction.

7. A joint reinforcing apparatus for an underground reinforced concrete wall, comprising, (1) a vertical support bar member, (2) a horizontally extending concrete anchor means rigidly secured to one surface of said vertical support bar member, (3) a plurality of reinforcing bar members, (4) a plurality of pivot means disposed along said vertical support bar member, each said pivot means associated with one of said reinforcing bar members and pivotally coupling the one end of its associated reinforcing bar members with said vertical support bar members, respectively, and (5) an operating member for moving said plurality of reinforcing bar members from a substantially vertical position to a substantially horizontal position, said vertical support bar member is a first U-shaped channel member and said one surface is the base of the U-opposite the opening thereof, wherein said operating member is an operating rod and said operating rod member is a second U-shaped channel member, said first and second U-shaped channel members opening opposite each other so as to enclose and protect said reinforcing bars during excavation for said underground reinforced concrete wall.

8. The invention defined in claim 7 wherein said concrete anchor means is constituted by a plurality of horizontally extending reinforcing bars welded to said vertical support bar.

9. The invention defined in claim 7 in which said operating member has a portion which projects upwardly above said slurry trench, whereby said portion can have a downward force applied to move said reinforcing bar members to horizontal position.

10. The invention defined in claim 7 wherein said second U-shaped channel member has a portion which projects upwardly above said slurry trench whereby said portion can have a downward force applied to move said reinforcing bars from said substantially vertical position to said substantially horizontal position.

11. In a steel reinforced concrete wall comprised of a plurality of concrete panels, each panel having a reinforcing cage extending to proximate the joint between concrete panels and a joint reinforcing cage bridging the gap between said reinforcing cages in adjoining panels, the improvement in said joint reinforcing cage comprising, a pair of oppositely facing channel members, a plurality of reinforcing bars, each connected between said channel members, one of said channel members having a face at the joint between consecutive concrete panels, and anchor means extending from said face and parallel to at least that portion of said reinforcing cage extending proximate said joint.

12. In a removable hollow stop end pipe for use in the slurry trench construction of a reinforced concrete wall, the improvement comprising, means forming at least one expandable joint reinforcing cage carrier channel in a wall of said removable stop end pipe facing a portion of a slurry trench to be concreted, said at least one channel being adapted to sealingly carry an in situ expandable reinforcing cage in an unexpanded condition and to maintain said expandable reinforcing cage in a predetermined expanded position until the concrete in said reinforced concrete wall has set.

13. In combination, the hollow stop end pipe defined in claim 12, wherein said hollow stop end pipe is rectangular in cross-section and an expandable joint reinforcing cage is carried in said carrier channel, said expandable joint reinforcing cage comprising, (1) a vertical support bar member, (2) a plurality of horizontally extending concrete anchor members rigidly secured to one surface of said vertical support bar member and extending out of said channel member, (3) a plurality of reinforcing bar members, (4) a plurality of pivot means disposed along said vertical support bar member, each said pivot means associated with one of said reinforcing bar members and pivotally coupling the one end of its associated reinforcing bar member with said vertical support bar members, respectively, and (5) an operating rod member for moving said plurality of reinforcing bar members from a substantially vertical position to a substantially horizontal position.

14. In combination, the hollow end stop pipe defined in claim 12 and a steel reinforcing cage for forming a reinforced joint in said reinforced concrete wall, each said cage comprising, a pair of abutting, oppositely facing steel U-shaped channel members, a plurality of steel reinforcing bars, means pivotally connecting an end of each reinforcing bar to a respective one of said U-shaped channel members; and steel concrete anchor means projecting from the side of one of said channel members opposite the pivotal connections to said plurality of reinforcing bars and outside said carrier channels.

15. The hollow stop end pipe defined in claim 12 wherein said carrier channel is constituted by a pair of parallel ribs on the external surface of said stop end pipe.

16. In combination, the hollow stop end pipe defined in claim 15, and an expandable joint reinforcing cage carried in said carrier channel, said expandable joint reinforcing cage comprising, (1) a vertical support bar member extending between said pair of parallel ribs, (2) a plurality of horizontally extending concrete anchor members rigidly secured to one surface of said vertical support bar member and extending out of said channel member, (3) a plurality of reinforcing bar members, (4) a plurality of pivot means disposed along said vertical support bar member, each said pivot means associated with one of said reinforcing bar members and pivotally coupling the one end of its associated reinforcing bar member with said vertical support bar members, respectively, and (5) an operating rod member for moving said plurality of reinforcing bar members from a substantially vertical position to a substantially horizontal position.

17. The combination defined in claim 16 wherein said vertical support bar member is a U-shaped channel nested between said pair of parallel ribs.

* * * * *